US007119486B2

(12) United States Patent
Godyak et al.

(10) Patent No.: US 7,119,486 B2
(45) Date of Patent: Oct. 10, 2006

(54) RE-ENTRANT CAVITY FLUORESCENT LAMP SYSTEM

(75) Inventors: Valery A. Godyak, Brookline, MA (US); Benjamin M. Alexandrovich, Brookline, MA (US); Alexander A. Sapozhnikov, Framingham, MA (US); Kenneth R. Hutcherson, Stafford, VA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/883,077

(22) Filed: Jul. 1, 2004

(65) Prior Publication Data

US 2005/0099141 A1 May 12, 2005

Related U.S. Application Data

(60) Provisional application No. 60/519,143, filed on Nov. 12, 2003.

(51) Int. Cl.
*H01J 1/62* (2006.01)

(52) U.S. Cl. ..... 313/490; 313/488

(58) Field of Classification Search ..... 313/490, 313/488, 550, 552, 562; 315/248
See application file for complete search history.

(56) References Cited

U.S. PATENT DOCUMENTS

| | | | | |
|---|---|---|---|---|
| 4,117,378 | A | 9/1978 | Glascock, Jr. | 315/248 |
| 4,119,889 | A | 10/1978 | Hollister | 315/248 |
| 4,536,675 | A | 8/1985 | Postma | 313/46 |
| 4,675,577 | A | 6/1987 | Hanlet | 315/248 |
| 4,704,562 | A | 11/1987 | Postma et al. | 315/248 |
| 4,927,217 | A | 5/1990 | Kroes et al. | 315/248 |
| 5,130,912 | A | 7/1992 | Friederichs et al. | 362/263 |
| 5,343,126 | A | 8/1994 | Farrall et al. | 315/248 |
| 5,412,280 | A | 5/1995 | Scott et al. | 313/573 |
| 5,500,567 | A | 3/1996 | Wilson et al. | 313/490 |
| 5,723,941 | A * | 3/1998 | Roelevink | 313/493 |
| 5,751,110 | A * | 5/1998 | Spaapen et al. | 313/550 |
| 5,912,536 | A * | 6/1999 | Michiels et al. | 315/248 |
| 6,084,359 | A * | 7/2000 | Hetzel et al. | 315/248 |
| 6,097,137 | A * | 8/2000 | Forsdyke et al. | 313/161 |
| 6,768,254 | B1 * | 7/2004 | Arakawa et al. | 313/493 |

* cited by examiner

*Primary Examiner*—Tuyet Thi Vo
(74) *Attorney, Agent, or Firm*—Carlo S. Bessone

(57) ABSTRACT

An electrodeless fluorescent lamp (10) having a burner (20), a ballast housing (30) containing a ballast (40) and a screw base (50) for connection to a power supply. A reentrant cavity (60) is formed in the burner (20) and an amalgam receptacle (70) containing amalgam (75) is formed as a part of the reentrant portion and in communication with the burner (20). A housing cap (80), formed of a suitable plastic, connects the burner (20) to the ballast housing (30) and a suitable adhesive (31) fixes the burner to the housing cap (80). An EMI cup (90) is formed as an insert to fit into the ballast housing (30), which also is formed of a suitable plastic, and has a bottom portion (100) and an EMI cap (110) with an aperture (120) therein closing an upper portion (140). The EMI cup (90) and the EMI cap (110) are preferably formed from 0.5 mm brass. The amalgam receptacle (70) extends through the aperture (120) and into the cup (90). For a fixed amalgam position, changing the aperture size allows adjustment of the amalgam tip temperature, and thus, allows control of the system lumen output, efficacy, CCT and CRI, all of which are dependent on the amalgam temperature.

5 Claims, 2 Drawing Sheets

RE-ENTRANT CAVITY FLUORESCENT LAMP SYSTEM

CROSS REFERENCE TO RELATED APPLICATIONS

This application claims priority from Provisional Patent Application Ser. No. 60/519,143 filed Nov. 12, 2003.

TECHNICAL FIELD

This invention relates to fluorescent lamps and more particularly to electrodeless fluorescent lamps. Still more particularly, it relates to such lamps having a reentrant cavity.

BACKGROUND ART

As market forces call for more efficient fluorescent lamps to be smaller and more incandescent in shape, conventional electroded fluorescent lamp faces difficult hurdles. The A-shaped bulb that covers conventional electroded discharges causes an approximately 8% lumen decrease due to reflection loss. The gas separation between the electroded lamp's tubular phosphor layer (where the heat is generated) and the A-shaped outer covering (where heat escapes the system) leads to inherently higher system temperatures. Higher temperatures lead to significant problems in producing higher lumen (e.g., >15 W, 800 lumen), A-shaped electroded systems.

Electrodeless fluorescent discharge lamps have solved many of the problems associated with the previous attempts to market compact fluorescent lamps. The discharge chamber can be made in the A-shape so there is no need for an outer covering. The phosphor is on the A-shape portion of the lamp so cooling is more effective. Such compact electrodeless lamps have been on the market for some time and basically comprise two different types; one type being an inductively driven plasma discharge with a separate ballast; and the other being an integrally ballasted, inductively driven discharge. The latter type of electrodeless discharge lamp works well generally; however, it presents some problems with heat, inadequate RF shielding for some uses, and inadequate temperature control for the amalgam.

DISCLOSURE OF INVENTION

It is, therefore, an object of the invention to obviate the disadvantages of the prior art.

It is another object of the invention to enhance the operation of electrodeless fluorescent lamps.

Yet another object of the invention is a fluorescent lamp having better amalgam temperature control.

Still another object of the invention is the provision of an electrodeless fluorescent lamp with good RF shielding at a reasonable cost.

These objects are accomplished, in one aspect of the invention, by the provision of an electrodeless fluorescent lamp having a burner, a ballast housing containing a ballast and a base for connection to a power supply. A reentrant cavity is provided in the burner and an amalgam receptacle is in communication with the burner. A housing cap connects the burner to the ballast housing and there is an EMI cup formed as part of the ballast housing. The EMI cup has a bottom portion and a cap with an aperture therein closing an upper portion. The amalgam receptacle extends through the aperture and into the ballast housing, which helps to regulate the amalgam temperature. The ballast housing provides superior RF shielding allowing multiple uses of the lamp in places previously unavailable.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
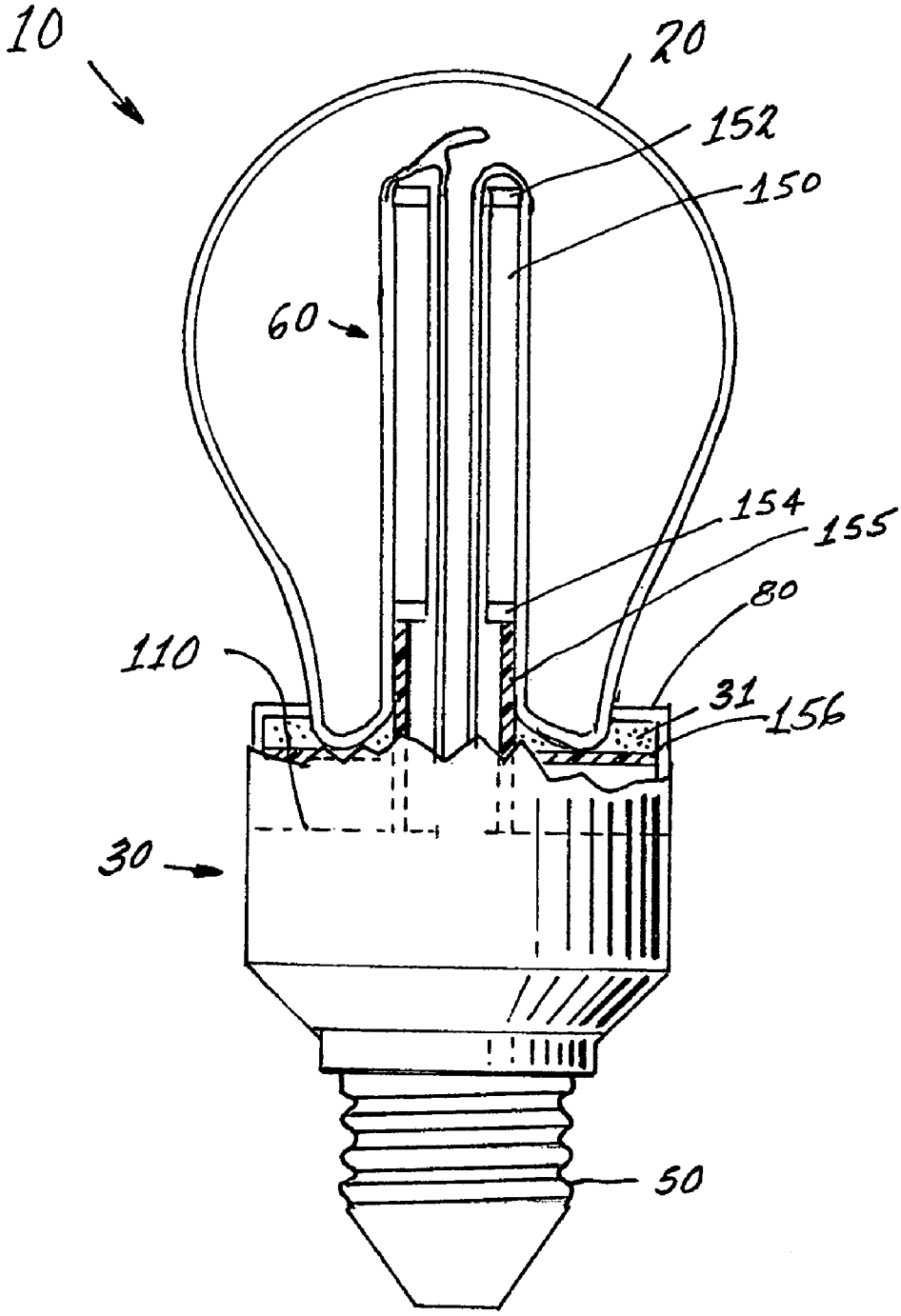
FIG. 1 is an elevational view of an embodiment of the invention, partially in section.
Figure 2:
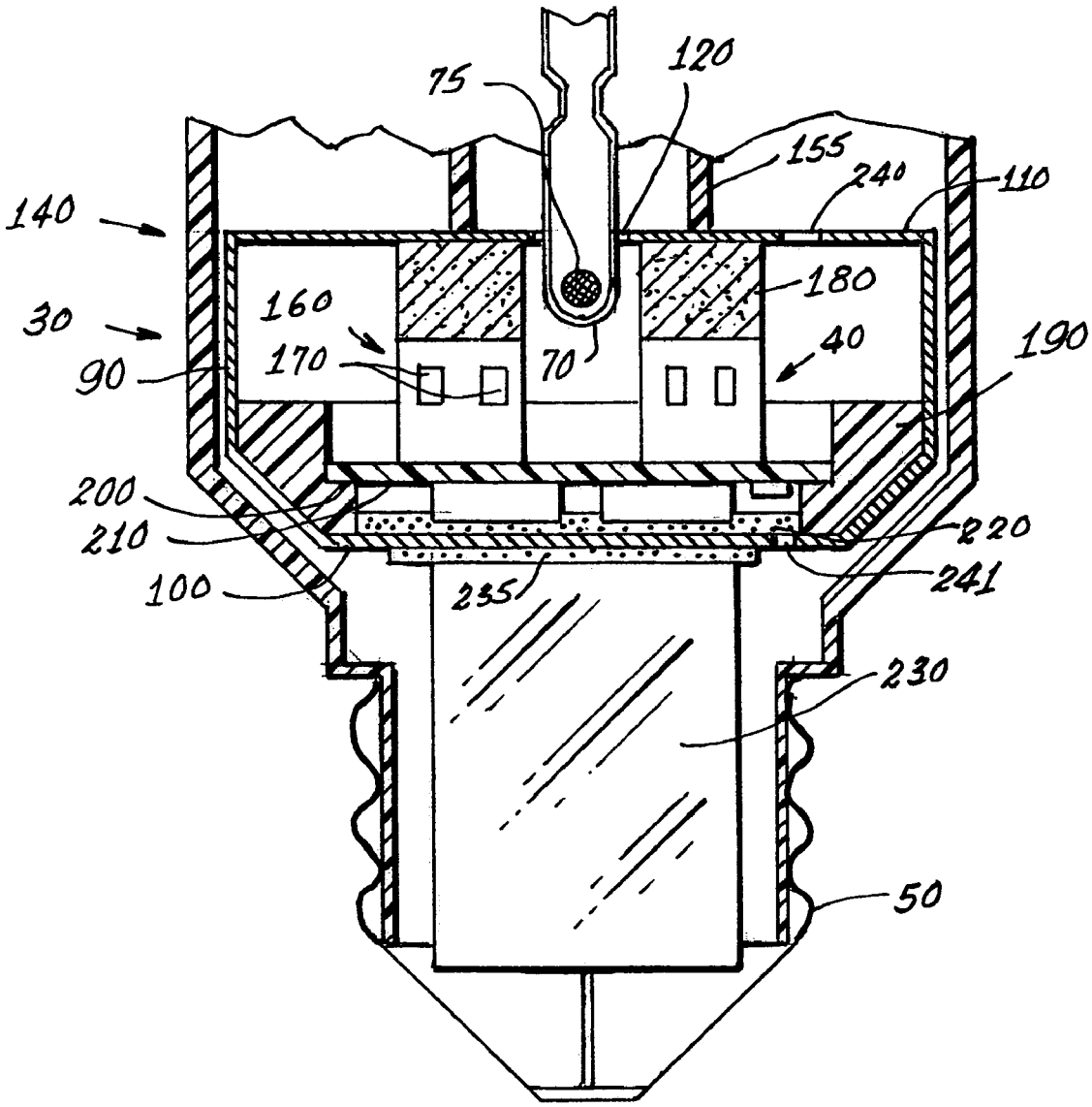
FIG. 2 is an enlarged sectional view of the ballast housing of the invention.

Referring now to the drawings with greater particularity, there is shown in FIG. 1 an electrodeless fluorescent lamp 10 having a burner 20, a ballast housing 30 containing a ballast 40 and a screw base 50 for connection to a power supply. A reentrant cavity 60 is formed in the burner 20 and an amalgam receptacle 70 containing amalgam 75 is formed as a part of the reentrant portion and in communication with the burner 20. A housing cap 80, formed of a suitable plastic, connects the burner 20 to the ballast housing 30 and a suitable adhesive 31 fixes the burner to the housing cap 80. An EMI cup 90 is formed as an insert to fit into the ballast housing 30, which also is formed of a suitable plastic, and has a bottom portion 100 and an EMI cap 110 with an aperture 120 therein closing an upper portion 140. The EMI cup 90 and the EMI cap 110 are preferably formed from 0.5 mm brass. The amalgam receptacle 70 extends through the aperture 120 and into the cup 90. For a fixed amalgam position, changing the aperture size allows adjustment of the amalgam tip temperature, and thus, allows control of the system lumen output, efficacy, CCT and CRI, all of which are dependent on the amalgam temperature.

A coupler in the form of a wire-wrapped a ferrite tube 150 is positioned in the reentrant cavity 60 and includes a thermally insulating coupler cap 152 and a coupler base 154 formed of ceramic paper containing high purity alumina based refractory fibers, such as Rescor 300 available from Cotronics Corporation. Kapton tape may be used to secure the wire wrapping at the top and bottom of the ferrite core. A burner housing insulation 155 is fitted into the reentrant portion and also serves to support the ferrite core. Housing insulation 155 is preferably made from black nylon. A flange 156 centers the housing insulation 155 within the ballast housing 30.

The EMI cup 90 contains a ballast board 160 containing ballast components 170, and the ballast board is positioned adjacent the bottom portion 100 of the cup 90 and a gasket 180 is positioned adjacent the upper portion 140 of the cup 90 and against the cap 110. The gasket 180 holds the ballast board 160 in place and provides cushioning for axial shocks to the lamp 10. The gasket 180 is preferably constructed of silicone foam rubber.

The EMI cup 90 additionally contains an annular centering ring 190 that is preferably formed from nylon and that surrounds the ballast board 160 and includes an inwardly extending flange 200 upon which the ballast board 160 rests for maintaining a fixed distance between a bottom 210 of the ballast board 160 and the bottom portion 100 of the EMI cup 90.

The EMI cup 90 also contains a ballast heat sink 220 that is applied in a viscous state to encompass surface mount components on the bottom 210 of the ballast board 160, whereby both electrical isolation and thermal contact are formed to provide cooling of the ballast 40 on the ballast board 160. In a preferred embodiment of the invention the ballast heat sink is comprised of a thermally conductive epoxy and 5 to 6 grams of Sylgard 165, available from Dow Corning.

A DC board 230 can be positioned in the screw base 50 and is insulated from the EMI cup 90 by an insulating disc 235 of, preferably, Nomex, about 0.005 inches thick.

Apertures, such as 240 in the EMI cap 110 and 241 in the bottom 100 of EMI cup 90, are provided to allow the threading of the necessary connecting wires.

There is thus provided an electrodeless fluorescent lamp having minimal interference with nearby electrical appliances due to its RF shielding and with excellent amalgam temperature control.

While there have been shown and described what are at present considered to be the preferred embodiments of the invention, it will be apparent to those skilled in the art that various changes and modification can be made herein without departing from the scope of the invention as defined by the appended claims.

What is claimed is:

1. In an electrodeless fluorescent lamp having a burner, a ballast housing containing a ballast and a base for connection to a power supply, the improvement comprising:

a reentrant cavity in said burner;

an amalgam receptacle in communication with said burner;

a housing cap connecting said burner to said ballast housing;

an EMI cup formed as part of said ballast housing, said EMI cup having a bottom portion and having a cap with an aperture therein closing an upper portion, said amalgam receptacle extending through said aperture and into said ballast housing.

2. The electrodeless fluorescent lamp of claim 1 wherein a ferrite tube is positioned in said reentrant cavity.

3. The electrodeless fluorescent lamp of claim 2 wherein said EMI cup contains a ballast board containing ballast components, said ballast board being positioned adjacent said bottom portion and a gasket positioned adjacent said upper portion, said gasket holding said ballast board in place and providing cushioning for axial shocks to said lamp.

4. The electrodeless fluorescent lamp of claim 3 wherein said EMI cup contains an annular centering ring surrounding said ballast board and including an inwardly extending flange upon which said ballast board rests for maintaining a fixed distance between a bottom of said ballast board and said bottom portion of said EMI cup.

5. The electrodeless fluorescent lamp of claim 4 wherein said EMI cup contains a ballast heat sink applied in a viscous state to encompass surface mount components on said bottom of said ballast board whereby electrical isolation and thermal contact are formed to provide cooling of the ballast on said ballast board.

* * * * *